US009812812B2

(12) United States Patent
Komoto

(10) Patent No.: US 9,812,812 B2
(45) Date of Patent: Nov. 7, 2017

(54) SNAP BUTTON CONNECTOR

(71) Applicant: Japan Aviation Electronics Industry, Limited, Tokyo (JP)

(72) Inventor: Tetsuya Komoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/445,249

(22) Filed: Feb. 28, 2017

(65) Prior Publication Data

US 2017/0288338 A1 Oct. 5, 2017

(30) Foreign Application Priority Data

Mar. 30, 2016 (JP) ..... 2016-068185

(51) Int. Cl.

| | |
|---|---|
| ***H01R 33/00*** | (2006.01) |
| ***H01R 13/64*** | (2006.01) |
| ***H01R 13/629*** | (2006.01) |
| ***H01R 13/26*** | (2006.01) |
| ***H01R 13/627*** | (2006.01) |

(52) U.S. Cl.

CPC ..... *H01R 13/629* (2013.01); *H01R 13/26* (2013.01); *H01R 13/6278* (2013.01)

(58) Field of Classification Search

CPC .. H01R 13/629; H01R 13/6278; H01R 13/24; H01R 13/26; H01R 13/6277

See application file for complete search history.

(56) References Cited

U.S. PATENT DOCUMENTS

| | | | | |
|---|---|---|---|---|
| 5,980,266 | A * | 11/1999 | Hsu | H01R 13/2421 439/37 |
| 7,462,035 | B2 * | 12/2008 | Lee | H01R 12/592 439/121 |
| 9,627,804 | B2 * | 4/2017 | Barth | H01R 13/627 |
| 2007/0026695 | A1 | 2/2007 | Lee et al. | |
| 2010/0100997 | A1 | 4/2010 | Lee et al. | |

FOREIGN PATENT DOCUMENTS

| | | | |
|---|---|---|---|
| EP | 2757639 | A1 | 7/2014 |
| JP | 2015-135723 | A | 7/2015 |
| KR | 20140008971 | A | 1/2014 |
| WO | WO 01/15286 | A1 | 3/2001 |
| WO | WO 2008007237 | A2 | 1/2008 |

* cited by examiner

*Primary Examiner* — Xuong Chung Trans
(74) *Attorney, Agent, or Firm* — Muncy, Geissler, Olds & Lowe, P.C.

(57) ABSTRACT

A snap button connector has a male connector portion and a female connector portion, the male connector portion including a male connector body with a convex portion, a plurality of first electrodes and one or more positioning keys, the female connector portion including a female connector body with a concave portion, a plurality of second electrodes, and one or more keys to be positioned, and when the male connector portion is fitted with the female connector portion, the convex portion and the positioning keys are fitted with the concave portion and the keys to be positioned, respectively, whereby the plurality of first electrodes are aligned with and electrically connected to the plurality of second electrodes.

18 Claims, 5 Drawing Sheets

SNAP BUTTON CONNECTOR

BACKGROUND OF THE INVENTION

The present invention relates to a snap button connector, and particularly to a snap button connector that is connected to a wearable device.

In recent years, so-called wearable devices, in which terminal devices such as various sensors and communication devices operate as being worn by a user, have attracted attention. Such a wearable device is electrically connected to a device like a measuring device or a power source to be used to transmit detected information or to receive power supply. While the electrical connection can be established via a connector attached to a garment, the connection via a connector has to be disconnected, for example, when the wearable device is removed and when the garment is washed.

Accordingly, as disclosed in JP 2015-135723 A, a snap button connector has been used to establish connection between devices.

As illustrated in FIG. 15, a snap button connector disclosed in JP 2015-135723 A includes a male snap button 2 attached to a first cloth 1 and a female snap button 4 attached to a second cloth 3. The first cloth 1 and the second cloth 3 are made from conductive cloth, while the male snap button 2 and the female snap button 4 are formed of a conductive material. As a convex portion 5 of the male snap button 2 is inserted into a concave portion 6 of the female snap button 4 and pressed down by two bar-like springs 7 of the female snap button 4, the male snap button 2 and the female snap button 4 are electrically connected, whereby the first cloth 1 and the second cloth 3 are electrically connected via the male snap button 2 and the female snap button 4.

Electrical connection of the wearable device can be made using a snap button connector of this type, and when the wearable device is removed or the garment is washed, for example, the electrical connection via the snap button connector can be disconnected by detachment of the male snap button 2 from the female snap button 4.

In the snap button connector of JP 2015-135723 A, however, since each of the male snap button 2 and the female snap button 4 functions entirely as a single electrode, connection of a plurality of wires would require as many snap button connectors as the number of the wires to be attached to a garment, leading to failure of miniaturization of a wearable device.

SUMMARY OF THE INVENTION

The present invention has been made in order to solve the conventional problem described above and is aimed at providing a snap button connector that can achieve miniaturization of a wearable device.

A snap button connector according to a first invention is one in which a male connector portion and a female connector portion are fitted with each other in a fitting direction, wherein the male connector portion includes: a male connector body having a first base portion and a convex portion projecting from a front surface of the first base portion in the fitting direction; a plurality of first electrodes arranged in a circumferential direction of the convex portion as being insulated from one another and each extending to a rear surface of the first base portion; and one or more positioning keys disposed on the front surface of the first base portion, wherein the female connector portion includes: a female connector body having a second base portion and a concave portion forming a recess in the fitting direction on a front surface of the second base portion; a plurality of second electrodes arranged in a circumferential direction of the concave portion as being insulated from one another and each extending to a rear surface of the second base portion; and one or more keys to be positioned disposed on the front surface of the second base portion, and wherein, when the male connector portion is fitted with the female connector portion, the convex portion and the positioning keys are fitted with the concave portion and the keys to be positioned, respectively, whereby the plurality of first electrodes are aligned with and electrically connected to the plurality of second electrodes.

A snap button connector according to a second invention is one in which a male connector portion and a female connector portion are fitted with each other in a fitting direction, wherein the male connector portion includes: a plurality of male connector bodies each having a first base portion and a convex portion projecting from a front surface of the first base portion in the fitting direction; and a plurality of first electrodes arranged in a circumferential direction of the convex portion of each of the plurality of male connector bodies as being insulated from one another and each extending to a rear surface of the first base portion, wherein the female connector portion includes: a plurality of female connector bodies each having a second base portion and a concave portion forming a recess in the fitting direction on a front surface of the second base portion; and a plurality of second electrodes arranged in a circumferential direction of the concave portion of each of the plurality of female connector bodies as being insulated from one another and each extending to a rear surface of the second base portion, and wherein, when the male connector portion is fitted with the female connector portion, the convex portion of each of the plurality of male connector bodies is fitted with the concave portion of each of the plurality of female connector bodies, whereby the plurality of first electrodes are aligned with and electrically connected to the plurality of second electrodes.

DETAILED DESCRIPTION OF THE INVENTION

Embodiments of the present invention are described below based on the appended drawings.

Embodiment 1

Figure 1:
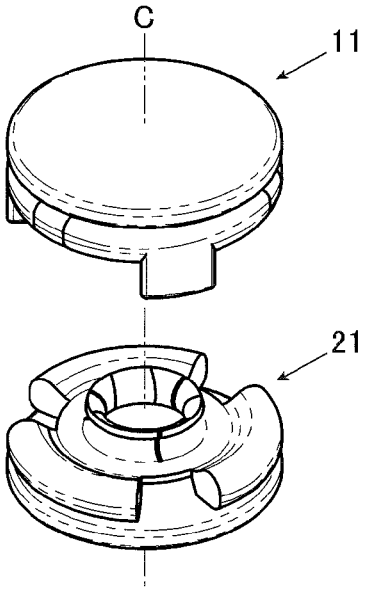
FIG. 1 is a perspective view showing a snap button connector according to Embodiment 1 before fitting.

FIG. 1 illustrates a structure of a snap button connector according to Embodiment 1. The snap button connector includes a male connector portion 11 and a female connector portion 21, which are fitted to each other in a fitting direction along a fitting axis C.

Figure 2:
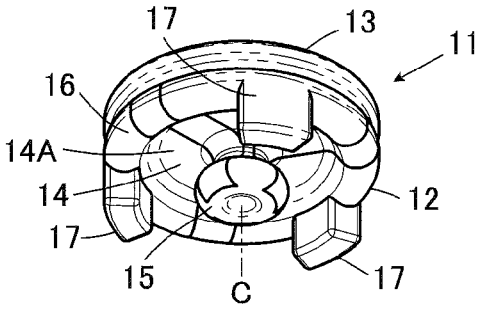
FIG. 2 is a perspective view showing a male connector portion used in the snap button connector according to Embodiment 1.

As illustrated in FIG. 2, the male connector portion 11 includes a male connector body 12 and a first attachment plate 13 that is attached to the male connector body 12. The male connector body 12 includes a first base portion 14 in a disk shape perpendicular to the fitting axis C and is provided, at a central part of the first base portion 14, with a convex portion 15 projecting from a front surface 14A of the first base portion 14 in the fitting direction. In addition, at the outer edge of the front surface 14A of the first base portion 14, a first raised portion 16 in an annular shape raised in the fitting direction is formed, and three positioning keys 17 projecting from the first raised portion 16 in the fitting direction are formed at the outer edge of the first base portion 14. The three positioning keys 17 are arranged at intervals of 120 degrees around the fitting axis C.

Figure 3:
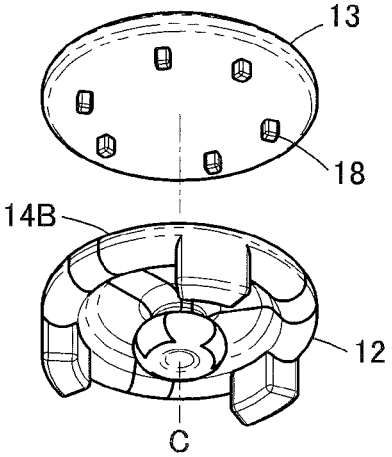
FIG. 3 is an exploded perspective view showing the male connector portion used in the snap button connector according to Embodiment 1.

The first attachment plate 13 is attached to a rear surface 14B of the first base portion 14 of the male connector body 12 and has a plurality of first protrusions 18 protruding toward the rear surface 14B of the first base portion 14, as illustrated in FIG. 3.

Figure 4A:
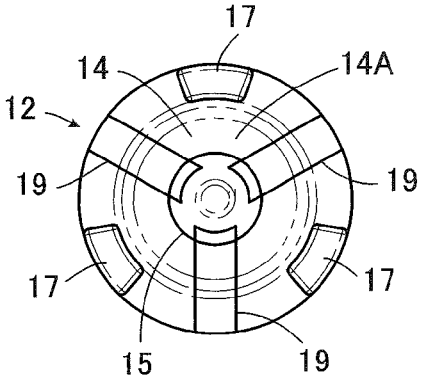
FIGS. 4A to 4C are a plan view, a side view and a bottom view, respectively, each showing a male connector body of the male connector portion used in the snap button connector according to Embodiment 1.
Figure 4C:
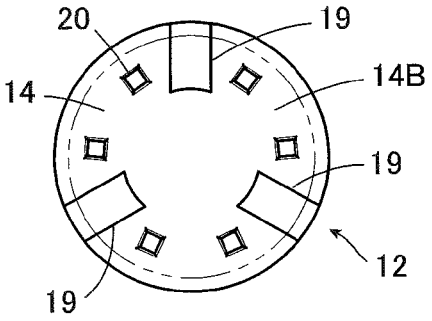
Figure 4B:
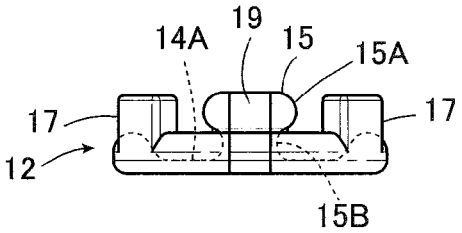

FIGS. 4A to 4C illustrate a structure of the male connector body 12. As illustrated in FIG. 4B, the convex portion 15 of the male connector body 12 has an overhanging portion 15A at its tip end in the fitting direction. The overhanging portion 15A has an outside diameter larger than that of a root portion 152 connected to the front surface 14A of the first base portion 14 and overhangs in a radial direction farther away from the root portion 15B.

As illustrated in FIG. 4A, on the front surface 14A of the first base portion 14 of the male connector body 12, three first electrodes 19 are formed at different rotational positions from those of the three positioning keys 17 and at intervals of 120 degrees as being insulated from one another in a circumferential direction of the convex portion 15. Each of the first electrodes 19 extends from an outer periphery of the convex portion 15 through the front surface 14A of the first base portion 14 and the surface of the first raised portion 16 to reach the rear surface 14B of the first base portion 14, as illustrated in FIGS. 42 and 4C.

In addition, as illustrated in FIG. 4C, the rear surface 14B of the first base portion 14 is provided with a plurality of first fitting holes 20. The plurality of first fitting holes 20 are arranged at positions corresponding to the plurality of first protrusions 18 of the first attachment plate 13 and are configured to be fitted with the first protrusions 18 of the first attachment plate 13 with a first cloth (not shown) held between the rear surface 14B of the first base portion 14 of the male connector body 12 and the first attachment plate 13. Through fitting of the first protrusions 18 and the first fitting holes 20, the first cloth is held by the male connector portion 11.

Figure 5:
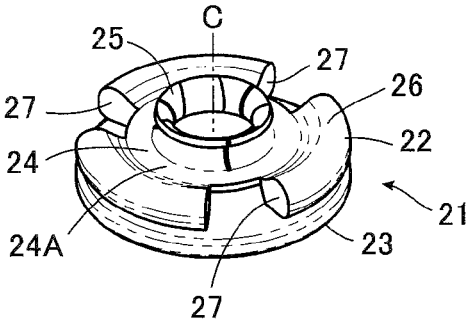
FIG. 5 is a perspective view showing a female connector portion used in the snap button connector according to Embodiment 1.

As illustrated in FIG. 5, the female connector portion 21 includes a female connector body 22 and a second attachment plate 23 that is attached to the female connector body 22. The female connector body 22 includes a second base portion 24 in a disk shape perpendicular to the fitting axis C and is provided, at a central part of the second base portion 24 and on a front surface 24A of the second base portion 24, with a concave portion 25 forming a recess in the fitting direction. In addition, at the outer edge of the front surface 24A of the second base portion 24, a second raised portion 26 raised in the fitting direction is formed, and the second raised portion 26 and the second base portion 24 are cut out, whereby three keys to be positioned 27 opening in the fitting direction are formed. The three keys to be positioned 27 are arranged at intervals of 120 degrees around the fitting axis C and are each configured to be slightly larger than each of the positioning keys 17 of the male connector body 12 such that the positioning keys 17 are inserted therein.

Figure 6:
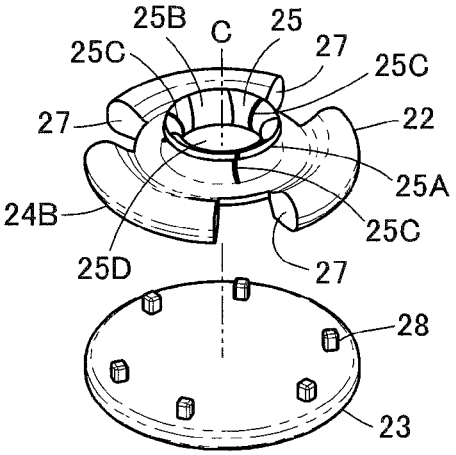
FIG. 6 is an exploded perspective view showing the female connector portion used in the snap button connector according to Embodiment 1.

The second attachment plate 23 is attached to a rear surface 24B of the second base portion 24 of the female connector body 22 and has a plurality of second protrusions 28 protruding toward the rear surface 24B of the second base portion 24, as illustrated in FIG. 6.

The concave portion 25 of the female connector body 22 is surrounded by a wall portion 25A extending from the front surface 24A of the second base portion 24 in the fitting direction and is provided with a projecting portion 25B that is formed on the wall portion 25A and projects in a radial direction toward the center of the concave portion 25. The concave portion 25 has a size corresponding to the convex portion 15 of the male connector body 12 and is designed such that an inside diameter of the projecting portion 25B is slightly smaller than an outside diameter of the overhanging portion 15A of the convex portion 15 and is slightly larger than that of an outside diameter of the root portion 153 of the convex portion 15.

In addition, the wall portion 25A is provided with three slits 25C at the same rotational positions as those of the three keys to be positioned 27. These slits 25C extend in the fitting direction and divide the wall portion 25A into three separate parts in the circumferential direction. Moreover, inside of the concave portion 25, a through-hole 25D that passes through the second base portion 24 in the fitting direction is formed.

Figure 7A:
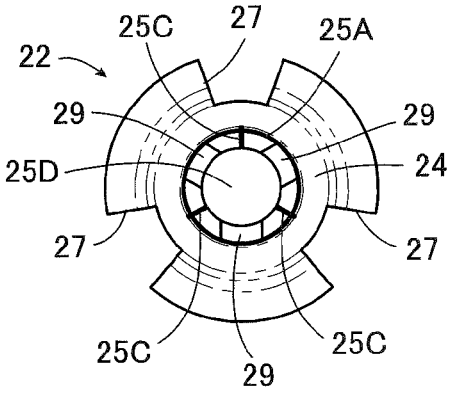
FIGS. 7A to 7C are a plan view, a side view and a bottom view, respectively, each showing a female connector body of the female connector portion used in the snap button connector according to Embodiment 1.
Figure 7C:
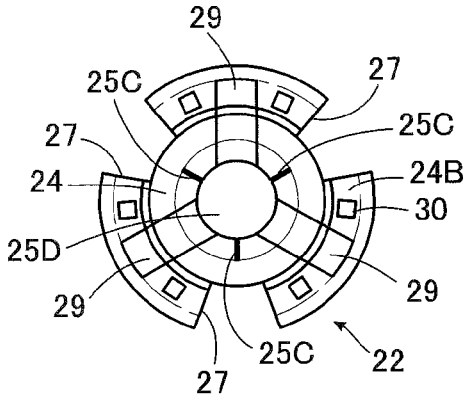
Figure 7B:
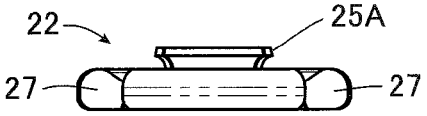

FIGS. 7A to 7C illustrate a structure of the female connector body 22. As illustrated in FIG. 7A, on the inner surface of the wall portion 25A of the female connector body 22, three second electrodes 29 are formed at intervals of 120 degrees as being insulated from one another in a circumferential direction of the concave portion 25. Each of the second electrodes 29 extends from the inner surface of the wall portion 25A of the concave portion 25 through the through-hole 25D to reach the rear surface 24B of the second base portion 24, as illustrated in FIG. 7C.

In addition, as illustrated in FIG. 7C, the rear surface 24B of the second base portion 24 is provided with a plurality of second fitting holes 30. The plurality of second fitting holes 30 are arranged at positions corresponding to the plurality of second protrusions 28 of the second attachment plate 23 and are configured to be fitted with the second protrusions 28 of the second attachment plate 23 with a second cloth (not shown) held between the rear surface 24B of the second base portion 24 of the female connector body 22 and the second attachment plate 23. Through fitting of the second protrusions 28 and the second fitting holes 30, the second cloth is held by the female connector portion 21.

The male connector body 12 of the male connector portion 11 may be formed of a metal material covered by an insulation layer and may be provided with the three first electrodes 19 on the insulation layer. By this constitution, while a metal is used as a material to form the male connector body 12, the three first electrodes 19 can be disposed as being insulated from one another.

Similarly, the female connector body 22 of the female connector portion 21 may be formed of a metal material covered by an insulation layer and may be provided with the three second electrodes 29 on the insulation layer. By this constitution, while a metal is used as a material to form the female connector body 22, the three second electrodes 29 can be disposed as being insulated from one another. In addition, since the wall portion 25A that forms the concave portion 25 of the female connector body 22 is divided into three separate parts in the circumferential direction by the three slits 25C, each separate part of the wall portion 25A divided by the slits 25C is formed to be elastically deformable in a radial direction, i.e., in a direction away from the fitting axis C, even though a metal material is used.

Figure 8:
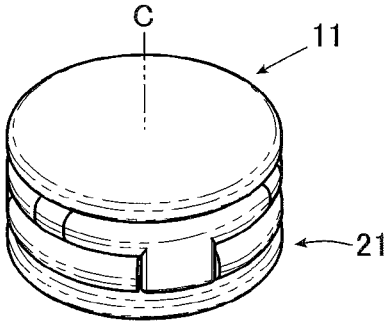
FIG. 8 is a perspective view showing the snap button connector according to Embodiment 1 at a time of fitting.
Figure 9:
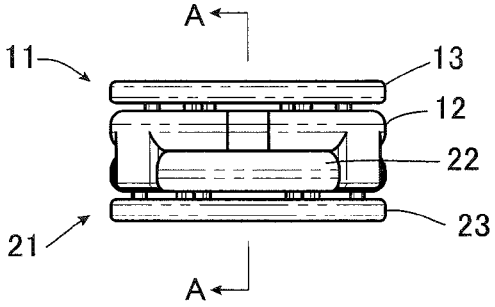
FIG. 9 is a side view showing the snap button connector according to Embodiment 1 at the time of fitting.

The thus-structured male connector portion 11 and female connector portion 21 are fitted to each other as illustrated in FIGS. 8 and 9 by relatively moving the portions 11 and 21 to come closer to each other along the fitting axis C, with the convex portion 15 of the male connector body 12 and the concave portion 25 of the female connector body 22 facing each other.

Figure 10:
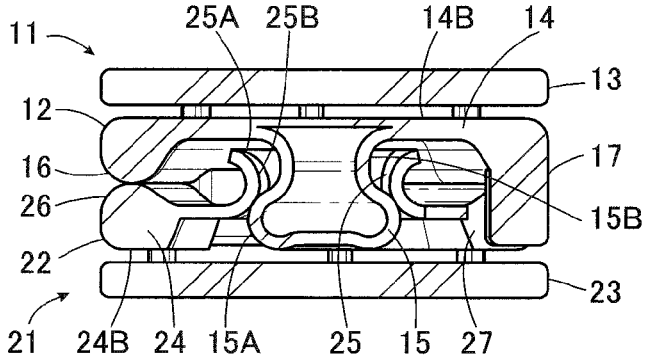
FIG. 10 is a cross-sectional view taken along line A-A of FIG. 9.

When the male connector portion 11 is fitted with the female connector portion 21, insertion of the three positioning keys 17 of the male connector body 12 respectively into the three keys to be positioned 27 of the female connector body 22 as well as insertion of the convex portion 15 of the male connector body 12 into the concave portion 25 of the female connector body 22 starts, the overhanging portion 15A of the convex portion 15 comes into contact with the wall portion 25A of the concave portion 25, and the three separate parts of the wall portion 25A divided in the circumferential direction by the slits 25C each elastically deform to get away from the fitting axis C in the radial direction. As illustrated in FIG. 10, with the overhanging portion 15A of the convex portion 15 being located on the second attachment plate 23 side beyond the projecting portion 25B of the wall portion 25A of the concave portion 25, the first raised portion 16 of the male connector body 12 comes into contact with the second raised portion 26 of the female connector body 22, whereby the fitting between the male connector portion 11 and the female connector portion 21 is established.

At this time, the projecting portion 253 of the concave portion 25 is in elastic contact with the convex portion 15 while being located on the root portion 153 side beyond the overhanging portion 15A of the convex portion 15; in this manner, although not shown in FIG. 10, the three first electrodes 19 arranged on the outer periphery of the convex portion 15 are electrically connected with the three second electrodes 29 arranged on the inner surface of the wall portion 25A of the concave portion 25.

In addition, when the three positioning keys 17 of the male connector body 12 are fitted with the three keys to be positioned 27 of the female connector body 22, the three first electrodes 19 are positionally aligned with the three second electrodes 29.

The first cloth on whose surface three wiring portions corresponding to the three first electrodes 19 of the male connector portion 11 are disposed as being insulated from each other is held between the male connector body 12 and the first attachment plate 13, thereby connecting the three wiring portions thereof with the three first electrodes 19 located on the rear surface 14B of the first base portion 14 of the male connector body 12. Similarly, the second cloth on whose surface three wiring portions corresponding to the three second electrodes 29 of the female connector portion 21 are disposed as being insulated from each other is held between the female connector body 22 and the second attachment plate 23, thereby connecting the three wiring portions thereof with the three second electrodes 29 located on the rear surface 24B of the second base portion 24 of the female connector body 22. Simply by fitting the male connector portion 11 and the female connector portion 21 to each other in the above-described state, it is possible to establish connection between the three wiring portions of the first cloth and the three wiring portions of the second cloth.

In addition, when the fitted male connector portion 11 and female connector portion 21 are moved away from each other along the fitting axis C, the convex portion 15 of the male connector body 12 is pulled out from the concave portion 25 of the female connector body 22, whereby the connection between the three first electrodes 19 of the male connector portion 11 and the three second electrodes 29 of the female connector portion 21 can be canceled.

The male connector body 12 of the male connector portion 11 and the female connector body 22 of the female connector portion 21 are each formed of a metal material covered by an insulation layer, but this is not the sole case, and the male connector body 12 and the female connector body 22 may be each formed of an insulating resin. In this case, there is no need to cover the material with an insulation layer, and even if the three first electrodes 19 or the three second electrodes 29 are disposed directly on the surface of an insulating resin, insulation among the electrodes can be maintained.

If the male connector body 12 and the female connector body 22 are formed of an insulating resin so that the wall portion 25A of the concave portion 25 of the female connector body 22 has a certain level of elasticity without having the slits 25C and thus allows the convex portion 15 of the male connector body 12 to be elastically fitted with the concave portion 25 of the female connector body 22, the wall portion 25A of the concave portion 25 does not need to have the slits 25C.

According to the above-described Embodiment 1, in the male connector portion 11, with the first cloth being sandwiched between the rear surface 143 of the first base portion 14 of the male connector body 12 and the first attachment plate 13, the first protrusions 18 of the first attachment plate 13 are fitted in the first fitting holes 20 of the male connector body 12, whereby the first cloth is held by the male connector portion 11. Similarly, in the female connector portion 21, with the second cloth being held between the rear surface 24B of the second base portion 24 of the female connector body 22 and the second attachment plate 23, the second protrusions 28 of the second attachment plate 23 are fitted in the second fitting holes 30 of the female connector body 22, whereby the second cloth is held by the female connector portion 21. However, the invention is not limited to the embodiment, and the male connector portion 11 and the female connector portion 21 may be attached to the first cloth and the second cloth by an attachment method of snap buttons and garment buttons adopted at conventional garment making facilities.

For instance, the male connector portion 11 may be attached to the first cloth with a claw portion, which is formed by a cut in the rear surface 14B of the first base portion 14 of the male connector body 12 made of a metal material and which is deformed to pinch the first cloth, or the male connector portion 11 may be sewed to the first cloth using a handicraft thread. In addition, the first electrode 19 of the male connector portion 11 may be directly sewed to the corresponding wiring portion of the first cloth using a conductive thread. Attachment of the female connector portion 21 to the second cloth may be made in a similar manner to that of the male connector portion 11.

Moreover, in the above-described Embodiment 1, the three positioning keys 17 of the male connector body 12 are respectively fitted in the three keys to be positioned 27 of the female connector body 22, but the number of the positioning keys 17 or the keys to be positioned 27 may be one, two or four or more. For instance, when a constitution in which one positioning key 17 is fitted in one key to be positioned 27 is adopted, the three first electrodes 19 correspond to the three second electrodes 29 one by one so that a specific first electrode 19 can be connected with a specific second electrode 29. Similarly, through fitting of one or more positioning keys 17 and keys to be positioned 27 that are asymmetrically shaped or asymmetrically positioned around the fitting axis C, a specific first electrode 19 can be connected with a specific second electrode 29.

The number of the first electrodes 19 disposed on the male connector portion 11 or the second electrodes 29 disposed on the female connector portion 21 is not limited to three but may be two, four or more.

Embodiment 2

Figure 11:
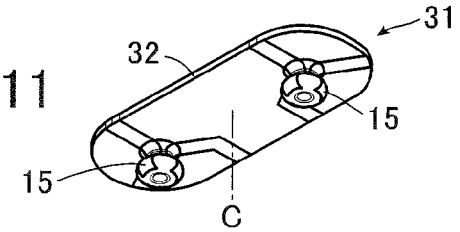
FIG. 11 is a perspective view showing a male connector body of a male connector portion used in a snap button connector according to Embodiment 2.

FIG. 11 shows a male connector body 31 of a male connector portion of a snap button connector according to Embodiment 2. The male connector body 31 is composed of a single first base portion 32 on which two convex portions 15 that are apart from each other are provided.

Figure 12A:
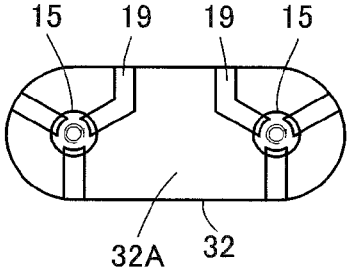
FIGS. 12A to 12C are a plan view, a side view and a bottom view, respectively, each showing the male connector body of the male connector portion used in the snap button connector according to Embodiment 2.
Figure 12C:
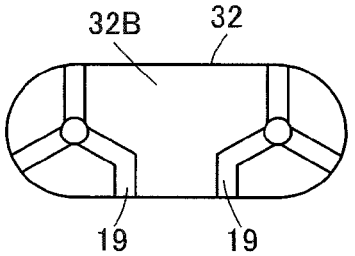
Figure 12B:
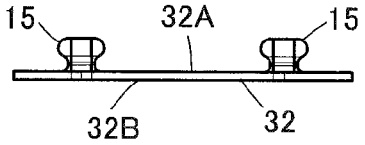

As illustrated in FIGS. 12A to 12C, each of the convex portions 15 is formed on a front surface 32A of the first base portion 32 and is provided at its outer periphery with three first electrodes 19. The three first electrodes 19 each extend from the outer periphery of each of the convex portions 15 through the front surface 32A of the first base portion 32 to reach a rear surface 32B of the first base portion 32.

Figure 13:
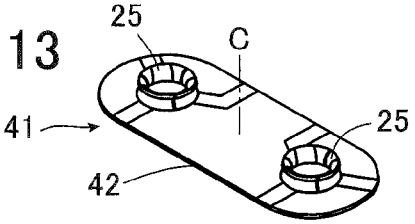
FIG. 13 is a perspective view showing a female connector body of a female connector portion used in the snap button connector according to Embodiment 2.

FIG. 13 shows a female connector body 41 of a female connector portion of the snap button connector according to Embodiment 2. A female connector body 41 is composed of a single second base portion 42 on which two concave portions 25 that are apart from each other are provided. The center-to-center distance of the two concave portions 25 is set to be the same as the center-to-center distance of the two convex portions 15 of the male connector body 31.

Figure 14A:
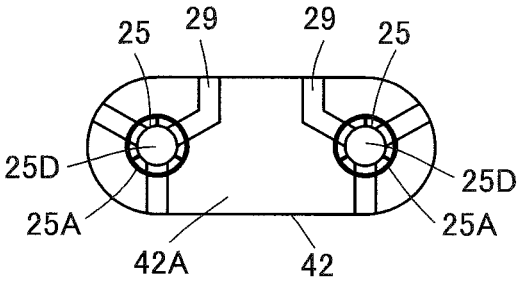
FIGS. 14A to 14C are a plan view, a side view and a bottom view, respectively, each showing the female connector body of the female connector portion used in the snap button connector according to Embodiment 2.
Figure 14C:
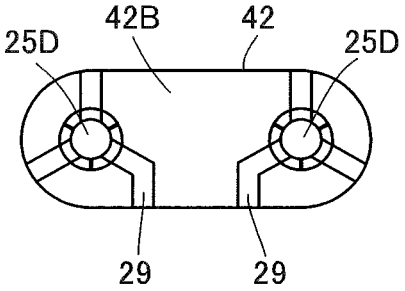
Figure 14B:
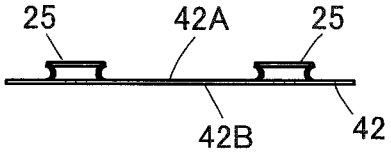
Figure 15:
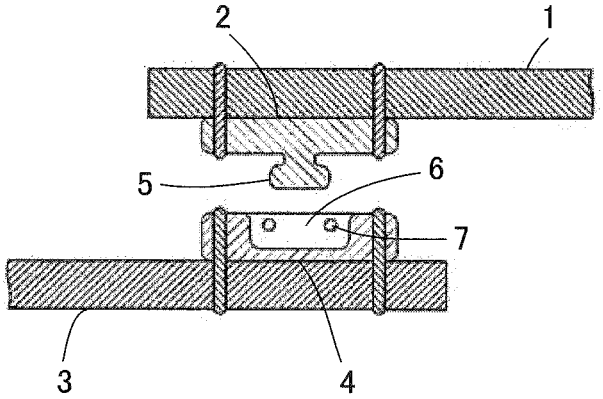
FIG. 15 is a cross-sectional view showing a conventional snap button connector.

As illustrated in FIGS. 14A to 14C, each of the concave portions 25 is formed on a front surface 42A of the second base portion 42 and is provided with three second electrodes 29 at an inner surface of a wall portion 25A forming the concave portion 25. The three second electrodes 29 each extend from the inner surface of the wall portion 25A of the concave portion 25 through a through-hole 25D to reach the rear surface 42B of the second base portion 42.

When the two convex portions 15 of the male connector body 31 are fitted in the two concave portions 25 of the female connector body 41 to thereby set up a relative rotation-positional relation between the convex portions 15 and the concave portions 25, the three first electrodes 19 of each of the convex portions 15 are automatically aligned with the three second electrodes 29 of the corresponding concave portion 25. Accordingly, in Embodiment 2, a total of six first electrodes 19 can be connected with a total of six second electrodes 29 simply through fitting of the male connector body 31 and the female connector body 41 along the fitting axis C, without using positioning keys 17 and keys to be positioned 27 like in Embodiment 1.

Similarly to the male connector body 12 and the female connector body 22 in Embodiment 1, the male connector body 31 and the female connector body 41 may be each formed of a metal material covered by an insulation layer, and the six first electrodes 19 may be disposed on the insulation layer of the male connector body 31 while the six second electrodes 29 may be disposed on the insulation layer of the female connector body 41.

For attachment of the male connector body 31 and the female connector body 41 to cloth, similarly to Embodiment 1, a method in which a first attachment plate and a second attachment plate (not shown) are used to hold cloth with the rear surface 32B of the first base portion 32 of the male connector body 31 and the rear surface 42B of the second base portion 42 of the female connector body 41, respectively, may be employed.

In another adoptable constitution, a first raised portion raised in the fitting direction may be formed at the outer edge of the front surface 32A of the first base portion 32 of the male connector body 31 while a second raised portion raised in the fitting direction may be formed at the outer edge of the front surface 42A of the second base portion 42 of the female connector body 41, so that the first raised portion of the male connector body 31 comes into contact with the second raised portion of the female connector body 41 when the male connector body 31 is fitted with the female connector body 41. Only one of the male connector body 31 and the female connector body 41 may be provided with the raised portion such that the raised portion comes into contact with the base portion of the other of the male connector body 31 and the female connector body 41 at the time of fitting.

In the above-described Embodiment 2, the male connector body 31 has two convex portions 15 disposed on a single first base portion 32, but this is not the sole case; the male connector body 31 may be constituted such that two convex portions 15 are disposed respectively on two separate first base portions, and the two first base portions are joined together. Illustrated in FIGS. 11 and 12A to 12C is the male connector body 31 composed of a single first base portion 32 that is made of two first base portions integrally formed and joined together.

Similarly, the female connector body 41 may be also constituted such that two concave portions 25 are disposed respectively on two separate second base portions, and the two second base portions are joined together. Illustrated in FIGS. 13 and 14A to 14C is the female connector body 41 composed of a single second base portion 42 that is made of two second base portions integrally formed and joined together.

It should be noted that the number of the convex portions 15 disposed on the male connector body 31 or the concave portions 25 disposed on the female connector body 41 is not limited to two but may be three or more.

What is claimed is:

1. A snap button connector in which a male connector portion and a female connector portion are fitted with each other in a fitting direction, wherein the male connector portion includes: a male connector body having a first base portion and a convex portion projecting from a front surface of the first base portion in the fitting direction; a plurality of first electrodes arranged in a circumferential direction of the convex portion as being insulated from one another and each extending to a rear surface of the first base portion; and one or more positioning keys disposed on the front surface of the first base portion, wherein the female connector portion includes: a female connector body having a second base portion and a concave portion forming a recess in the fitting direction on a front surface of the second base portion; a plurality of second electrodes arranged in a circumferential direction of the concave portion as being insulated from one another and each extending to a rear surface of the second base portion; and one or more keys to be positioned disposed on the front surface of the second base portion, and wherein, when the male connector portion is fitted with the female connector portion, the convex portion and the positioning keys are fitted with the concave portion and the keys to be positioned, respectively, whereby the plurality of first electrodes are aligned with and electrically connected to the plurality of second electrodes.

2. The snap button connector according to claim 1, wherein the positioning keys of the male connector portion are disposed at an outer edge of the first base portion and project in the fitting direction, and wherein the keys to be positioned of the female connector portion are disposed at an outer edge of the second base portion and formed to open in the fitting direction.

3. The snap button connector according to claim 1, wherein the convex portion of the male connector portion has, at a tip end thereof in the fitting direction, an overhanging portion overhanging in a radial direction farther away from a root portion that is connected to the front surface of the first base portion, wherein the concave portion of the female connector portion is surrounded by a wall portion extending from the front surface of the second base portion in the fitting direction and is provided with a projecting portion formed on the wall portion and projecting in a radial direction toward a center of the concave portion, and wherein, when the male connector portion is fitted with the female connector portion, the projecting portion of the concave portion is in elastic contact with the convex portion while being located between the root portion and the overhanging portion of the convex portion.

4. The snap button connector according to claim 3, wherein the plurality of first electrodes each extend from an outer periphery of the convex portion through the front surface of the first base portion and an outer edge of the first base portion to reach the rear surface of the first base portion, wherein the second base portion has a through-hole inside the concave portion, and wherein the plurality of second electrodes each extend from an inner surface of the wall portion of the concave portion through the through-hole to reach the rear surface of the second base portion.

5. The snap button connector according to claim 3, wherein the concave portion of the female connector portion has, in the wall portion, a plurality of slits extending in the fitting direction and dividing the wall portion into a plurality of separate parts in a circumferential direction.

6. The snap button connector according to claim 1, wherein the male connector body has a first raised portion disposed at an outer edge of the first base portion and raised in the fitting direction, wherein the female connector body has a second raised portion disposed at an outer edge of the second base portion and raised in the fitting direction, and wherein, when the male connector portion is fitted with the female connector portion, the first raised portion comes into contact with the second raised portion.

7. The snap button connector according to claim 1, wherein the male connector body and the female connector body are each formed of a metal material covered by an insulation layer, and wherein the plurality of first electrodes and the plurality of second electrodes are respectively disposed on the insulation layer of the male connector body and the insulation layer of the female connector body.

8. The snap button connector according to claim 1, wherein each of the male connector portion and the female connector portion is fixed to cloth.

9. The snap button connector according to claim 8, wherein the male connector portion includes a first attachment plate that is attached to the rear surface of the first base portion of the male connector body with the cloth held between the first attachment plate and the rear surface of the first base portion, and wherein the female connector portion includes a second attachment plate that is attached to the rear surface of the second base portion of the female connector body with the cloth held between the second attachment plate and the rear surface of the second base portion.

10. A snap button connector in which a male connector portion and a female connector portion are fitted with each other in a fitting direction, wherein the male connector portion includes: a plurality of male connector bodies each having a first base portion and a convex portion projecting from a front surface of the first base portion in the fitting direction; and a plurality of first electrodes arranged in a circumferential direction of the convex portion of each of the plurality of male connector bodies as being insulated from one another and each extending to a rear surface of the first base portion, wherein the female connector portion includes: a plurality of female connector bodies each having a second base portion and a concave portion forming a recess in the fitting direction on a front surface of the second base portion; and a plurality of second electrodes arranged in a circumferential direction of the concave portion of each of the plurality of female connector bodies as being insulated from one another and each extending to a rear surface of the second base portion, and wherein, when the male connector portion is fitted with the female connector portion, the convex portion of each of the plurality of male connector bodies is fitted with the concave portion of each of the plurality of female connector bodies, whereby the plurality of first electrodes are aligned with and electrically connected to the plurality of second electrodes.

11. The snap button connector according to claim 10, wherein first base portions of the plurality of male connector bodies are joined together, and wherein second base portions of the plurality of female connector bodies are joined together.

12. The snap button connector according to claim 10, wherein the convex portion of the male connector portion has, at a tip end thereof in the fitting direction, an overhanging portion overhanging in a radial direction farther away from a root portion that is connected to the front surface of the first base portion, wherein the concave portion of the female connector portion is surrounded by a wall portion extending from the front surface of the second base portion in the fitting direction and is provided with a projecting portion formed on the wall portion and projecting in a radial direction toward a center of the concave portion, and wherein, when the male connector portion is fitted with the female connector portion, the projecting portion of the concave portion is in elastic contact with the convex portion while being located between the root portion and the overhanging portion of the convex portion.

13. The snap button connector according to claim 12, wherein the plurality of first electrodes each extend from an outer periphery of the convex portion through the front surface of the first base portion and an outer edge of the first base portion to reach the rear surface of the first base portion, wherein the second base portion has a through-hole inside the concave portion, and wherein the plurality of second electrodes each extend from an inner surface of the wall portion of the concave portion through the through-hole to reach the rear surface of the second base portion.

14. The snap button connector according to claim 12, wherein the concave portion of the female connector portion has, in the wall portion, a plurality of slits extending in the fitting direction and dividing the wall portion into a plurality of separate parts in a circumferential direction.

15. The snap button connector according to claim 10, wherein each of the plurality of male connector bodies has a first raised portion disposed at an outer edge of the first base portion and raised in the fitting direction, wherein each of the plurality of female connector bodies has a second raised portion disposed at an outer edge of the second base portion and raised in the fitting direction, and wherein, when the male connector portion is fitted with the female connector portion, the first raised portion comes into contact with the second raised portion.

16. The snap button connector according to claim 10, wherein the plurality of male connector bodies and the plurality of female connector bodies are each formed of a metal material covered by an insulation layer, and wherein the plurality of first electrodes and the plurality of second electrodes are respectively disposed on the insulation layer of each of the plurality of male connector bodies and the insulation layer of each of the plurality of female connector bodies.

17. The snap button connector according to claim 10, wherein each of the male connector portion and the female connector portion is fixed to cloth.

18. The snap button connector according to claim 17, wherein the male connector portion includes a first attachment plate that is attached to the rear surface of the first base portion of each of the plurality of male connector bodies with the cloth held between the first attachment plate and the rear surface of the first base portion, and wherein the female connector portion includes a second attachment plate that is attached to the rear surface of the second base portion of each of the plurality of female connector bodies with the cloth held between the second attachment plate and the rear surface of the second base portion.

* * * * *